US009705251B2

(12) United States Patent
Noro et al.

(10) Patent No.: US 9,705,251 B2
(45) Date of Patent: Jul. 11, 2017

(54) LEVER-TYPE CONNECTOR

(71) Applicant: Sumitomo Wiring Systems, Ltd., Yokkaichi, Mie (JP)

(72) Inventors: Yutaka Noro, Mie (JP); Kazuaki Takeda, Mie (JP); Akihiro Kon, Mie (JP); Muneyuki Kikagawa, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/032,369

(22) PCT Filed: Oct. 8, 2014

(86) PCT No.: PCT/JP2014/076951
§ 371 (c)(1),
(2) Date: Apr. 27, 2016

(87) PCT Pub. No.: WO2015/064322
PCT Pub. Date: May 7, 2015

(65) Prior Publication Data

US 2016/0261069 A1 Sep. 8, 2016

(30) Foreign Application Priority Data

Oct. 29, 2013 (JP) ..... 2013-224436

(51) Int. Cl.
*H01R 13/62* (2006.01)
*H01R 13/629* (2006.01)

(52) U.S. Cl.
CPC . *H01R 13/62955* (2013.01); *H01R 13/62938* (2013.01)

(58) Field of Classification Search
CPC ..... H01R 13/62955; H01R 13/62938
(Continued)

(56) References Cited

U.S. PATENT DOCUMENTS

2003/0162426 A1 8/2003 Shinozaki et al.
2003/0166351 A1 9/2003 Shinozaki
(Continued)

FOREIGN PATENT DOCUMENTS

JP 2003-249303 9/2003
JP 2005-243276 9/2005
(Continued)

OTHER PUBLICATIONS

European Search Report Dated September 13, 2016.
International Search Report, (Oct. 29, 2014).

*Primary Examiner* — Khiem Nguyen
(74) *Attorney, Agent, or Firm* — Gerald E. Hespos; Michael J. Porco; Matthew T. Hespos

(57) ABSTRACT

A female connector housing (8) is provided with a lever accommodating portion (8B), and a lever (6) is rotatably mounted on an outer surface (18) of a main body portion (8A) inside. The lever (6) is provided with a lock arm (24). An operating portion (24B) is provided on a tip part of the lock arm (24) and covered by a protecting portion (28). In the case of separating male and female connectors (M, F), the locking of a lock protrusion (25) and a locking projecting edge (26) is released by pinching a first pinching surface (27) formed on the operating portion (24B) of the lock arm (24) and a second pinching surface (29) of the protecting portion (28). Since the first pinching surface (27) and the second pinching surface (29) are arranged along a deflecting direction of the lock arm (24), a pinching operation is facilitated.

8 Claims, 8 Drawing Sheets

(58) Field of Classification Search
USPC ..... 439/152, 153, 157
See application file for complete search history.

(56) References Cited

U.S. PATENT DOCUMENTS

| | | | |
|---|---|---|---|
| 2008/0102666 | A1 | 5/2008 | Yamashita |
| 2008/0146067 | A1 | 6/2008 | Shinozaki |

FOREIGN PATENT DOCUMENTS

| | | |
|---|---|---|
| JP | 2008-153102 | 7/2008 |
| JP | 2011-129419 | 6/2011 |
| JP | 2011-134661 | 7/2011 |

LEVER-TYPE CONNECTOR

BACKGROUND

1. Field of the Invention

The present invention relates to a lever-type connector.

2. Description of the Related Art

A connector disclosed in Japanese Unexamined Patent Publication No. 2003-249303 is configured such that a plate-like lever is rotatably mounted on one surface side of a female connector (holder) and male and female connectors are connected by displacing a cam follower provided on the male connector along a cam groove formed on the lever as the lever is rotated.

An accommodating recess is formed on the female connector and the lever is mounted into this accommodating recess. Further, a lock piece is deflectably formed on the lever and can lock the lever by being locked to a claw portion formed on a ceiling surface of the accommodating recess when the male and female connectors are in a connected state, and holds the male and female connectors in the connected state.

In the above lever-type connector, it is sufficient to rotate the lever in an opposite direction while releasing locking by the lock piece in the case of separating the male and female connectors. Specifically, a free end part of the lock piece is pushed down, for example, with a thumb while placing an index finger on a finger placing portion protruding from a tip part of the lever and, in that state, the lever is rotated.

However, since directions of pinching forces applied by the thumb and the index finger are orthogonal in the above structure, there has been a problem that operability during the separation is not necessarily good.

The present invention was completed based on the above situation and aims to provide a lever-type connector excellent in the separation operability of male and female connectors.

SUMMARY

The present invention is directed to a lever-type connector configured such that a first connector housing and a second connector housing are made connectable and separable by displacing a cam follower provided on the second connector housing along a cam groove formed on a lever. The lever is provided rotatably on an outer surface of a main body portion of the first connector housing and is rotated between an initial position and a connection end position. The lever-type connector includes a lock arm provided on the lever such that one end part of the lock arm is deflectable in a direction away from the outer surface of the main body portion and is configured to hold the lever at the connection end position by being locked to the first connector housing when the lever is at the connection end position. A first pinching surface is formed on a surface of the one end part of the lock arm facing the outer surface. A protecting is formed on the lever and is configured to cover the one end part of the lock arm from a side facing in a deflecting direction of the lock arm. A second pinching surface is formed on a part of an outer surface side of the protecting portion along the deflecting direction of the lock arm and enables the lever to rotate to the initial position by displacing the lock arm in an unlocking direction by a pinching operation of the first and second pinching surfaces when the lever is at the connection end position.

According to the present invention, in the case of connecting the first and second connector housings, the connector housings are fit lightly and the cam follower of the second connector housing is introduced into the cam groove of the lever of the first connector housing. When the lever is rotated in this state, the cam follower is displaced along the cam groove so that the connection of the connector housings proceeds. The both connector housings reach a properly connected state when the lever reaches the connection end position and the lock arm is locked to the first connector housing. In this way, the connector housings are locked in the properly connected state.

On the other hand, in the case of separating the both connector housings, the lock arm is unlocked and the lever at the connection end position is rotated to the initial position. During this time, it is sufficient to release locking by the lock arm by pinching the first pinching surface on the lock arm and the second pinching surface on the protecting portion and rotating the lever in that state. At this time, since the first and second pinching surfaces are both formed on parts arranged along the deflecting direction of the lock arm, the pinching operation is facilitated. As a result, the operation of separating the connector housings can be performed smoothly.

Further, since the second pinching surface is formed utilizing the protecting portion of the lock arm as an existing structure, the invention contributes to the simplification of the connector structure.

The first pinching surface of the lock arm may project out from an end edge of the first connector housing when the lever is at the connection end position. According to this configuration, when the first pinching surface is pinched to separate the connector housings, the interference of an operator's finger with the first connector housing can be avoided. Thus, the separating operation can be performed smoothly.

The second connector housing may include a tubular receptacle can fit externally to the first connector housing and the second pinching surface may be located to project out from a leading end edge of the receptacle when the first and second connector housings are in a connected state. According to this configuration, when the second pinching surface is pinched to separate the connector housings, the interference of an operator's finger with the second connector housing can be avoided. Thus, the separating operation can be performed smoothly.

A specific embodiment of a lever-type connector of the present invention is described with reference to the drawings.

DETAILED DESCRIPTION

Figure 2:
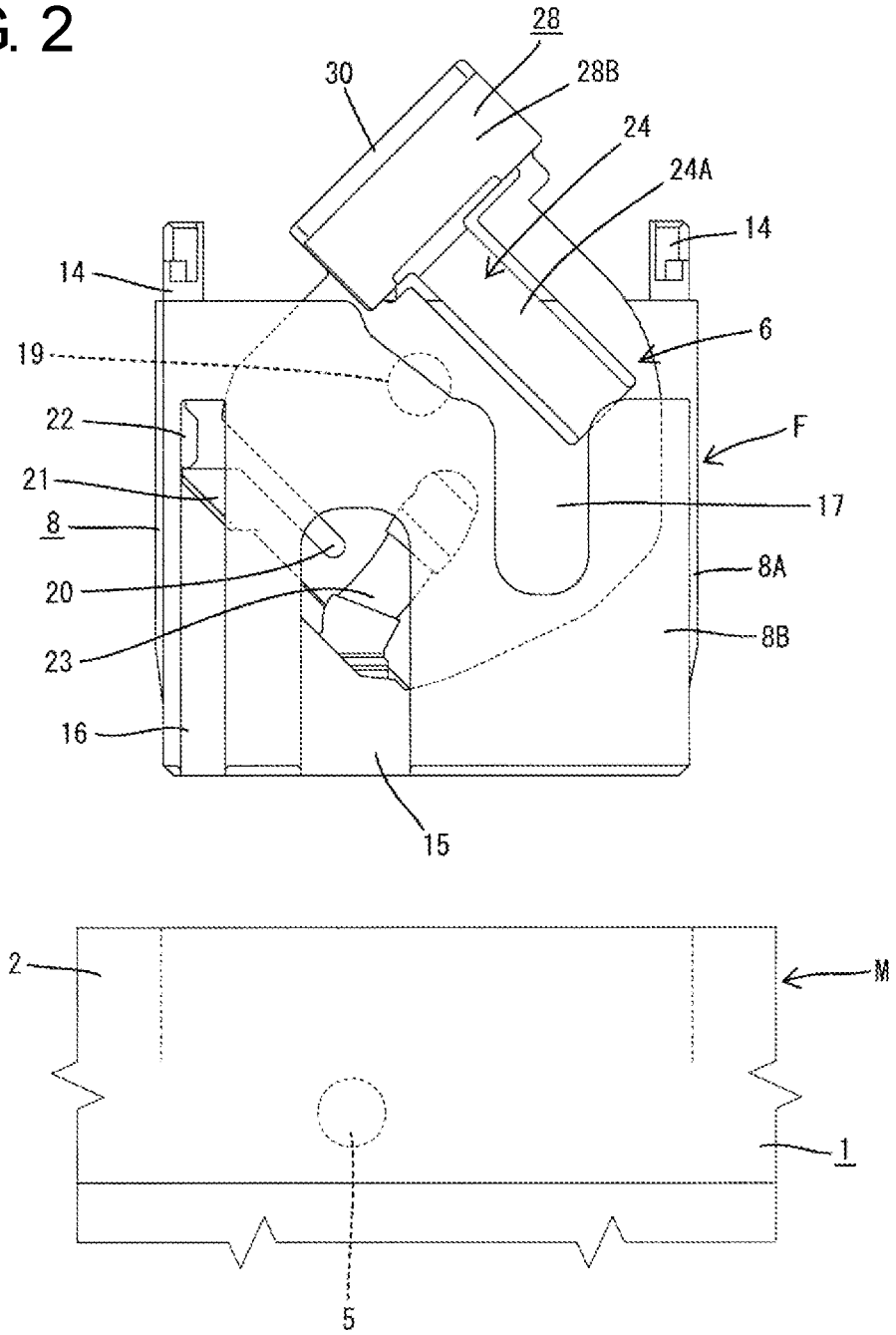
FIG. 2 is a plan view showing a state before male and female connectors are connected.

First, the configuration of a male connector M is described. Although the male connector M is not shown entirely, it is configured to include a total of three connector accommodating portions arranged side by side in a width direction and entirely mounted on an end part of a printed circuit board 3. FIG. 2 and other figures main show only the connector accommodating portion in a center. This connector accommodating portion in the center is referred to as a male connector housing 1 (second connector housing) below.

The male connector housing 1 is made of synthetic resin and includes a receptacle 2 in the form of a rectangular tube into which a female connector F can fit. Male terminal fittings 4 are accommodated in the male connector housing 1 while being arranged side by side in a height direction and the width direction. Each male terminal fitting 4 is held on a back wall of the receptacle 2 by being press-fitted with one end of each male terminal fitting 4 being formed into a tab that projects into the receptacle 2. The other ends of the male terminal fittings 4 project out from the receptacle 2. The other ends are bent substantially at a right angle at intermediate positions and are inserted into through holes formed to penetrate through the printed circuit board 3 and connected to conduction paths formed on the printed circuit board 3 by soldering.

Figure 3:
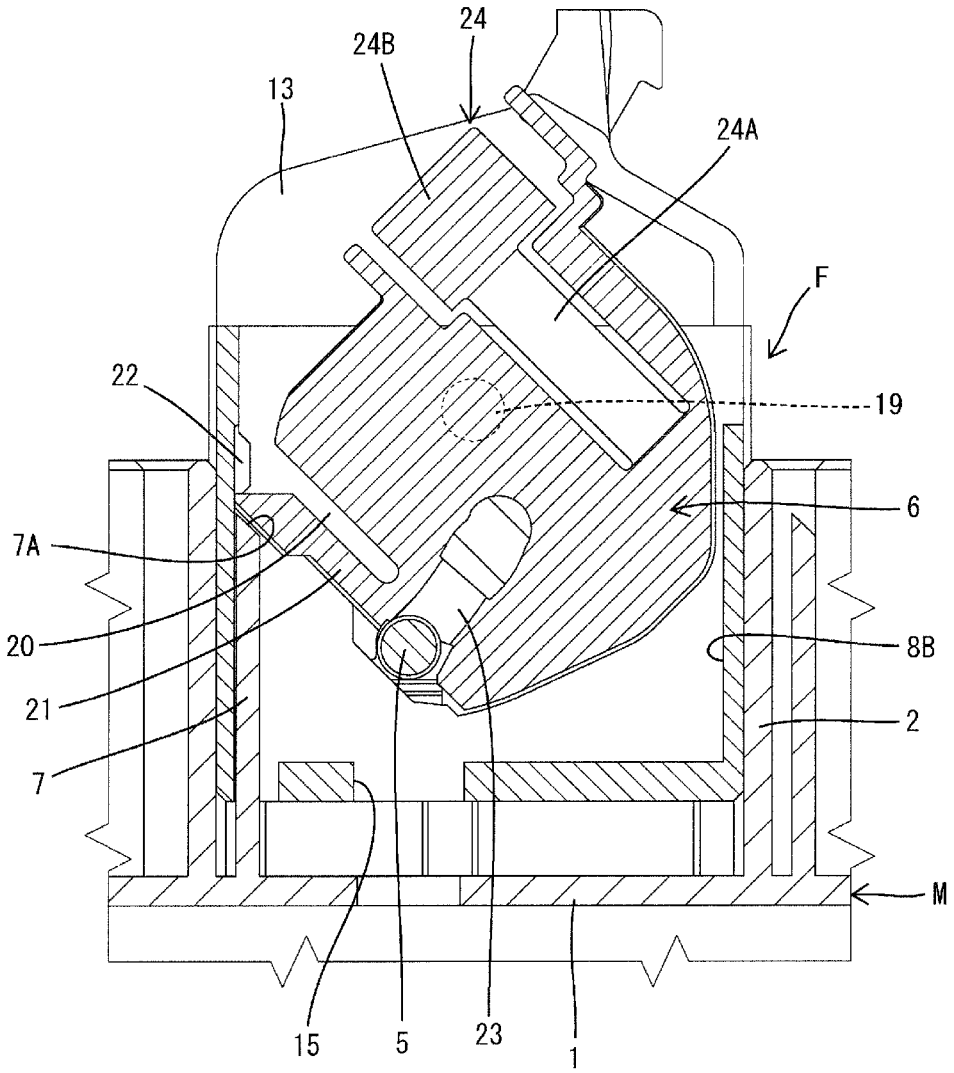
FIG. 3 is a plan view in section showing a state where the male connector is lightly fitted to the female connector when a lever is at an initial position.
Figure 4:
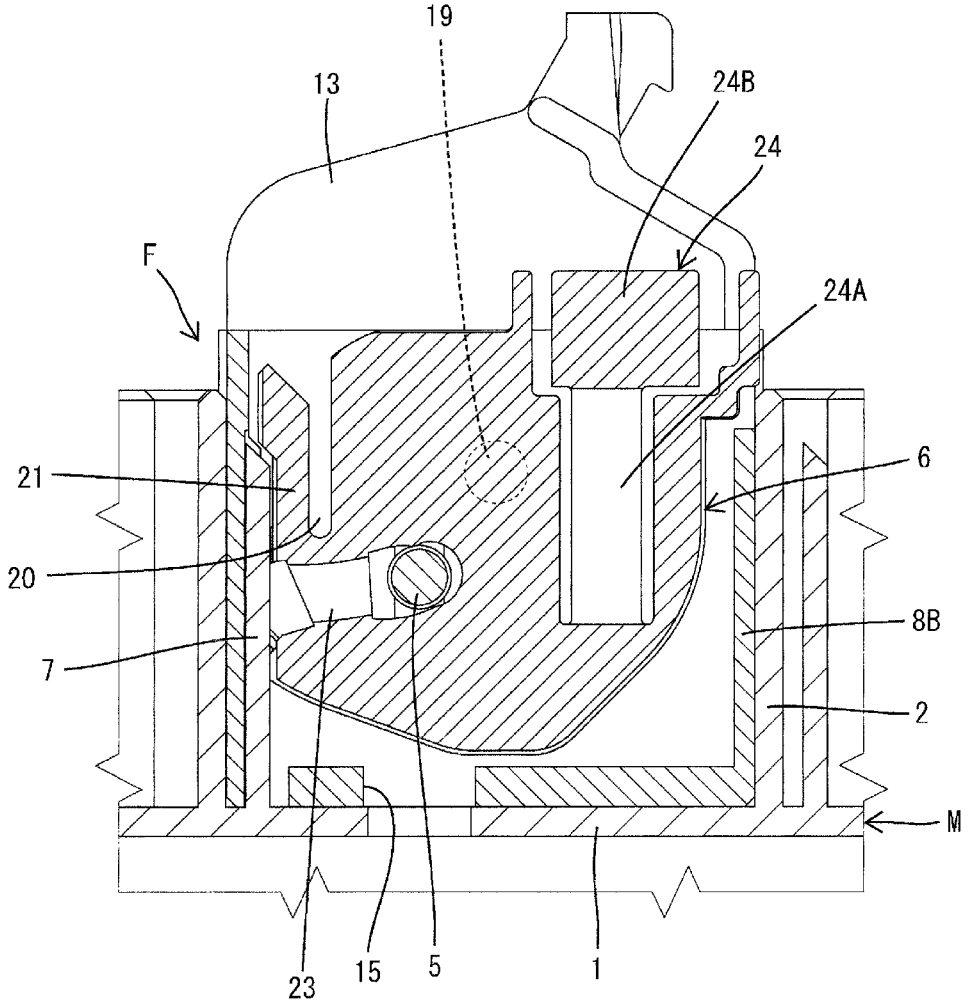
FIG. 4 is a plan view in section showing a state where the lever has reached a connection end position and the male and female connectors are properly connected.
Figure 5:
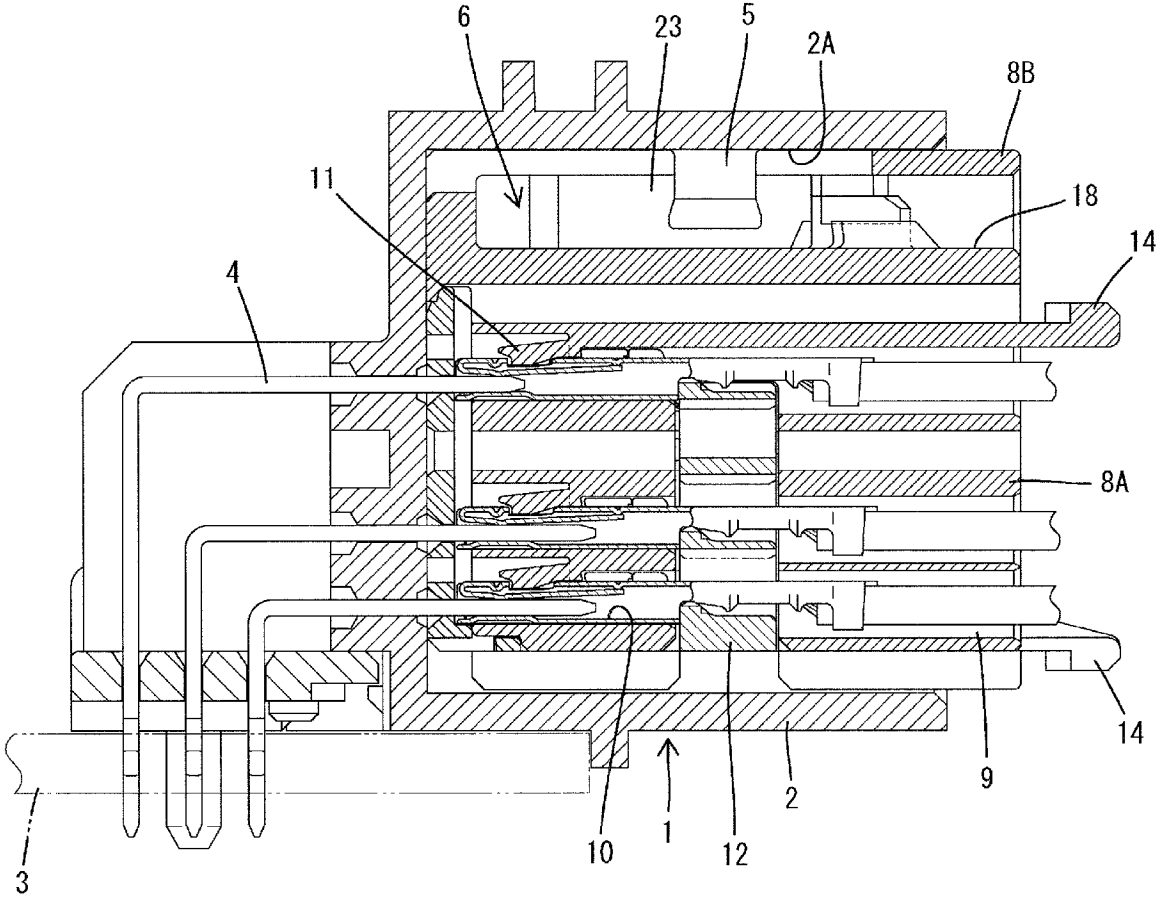
FIG. 5 is a side view in section showing a connected state of the male and female connectors.

As shown in FIG. 5, a cam follower 5 projects inwardly on a ceiling wall 2A of the receptacle 2. As shown in FIGS. 3, 4 and other figures, a releasing rib 7 projects inwardly near the cam follower 5 on the ceiling wall 2A of the receptacle 2. The releasing rib 7 functions to release a state where a lever 6 is held at an initial position. This releasing rib 7 is formed from an opening edge to the back wall of the receptacle 2 and extends in a connecting direction of the male and female connectors F, M. Further, a tapered pressing surface 7A is formed on the tip of the releasing rib 7.

Next, the female connector F is described. The female connector F includes a female connector housing 8 (first connector housing) made of synthetic resin. The female connector housing 8 is formed into a block that can fit into the receptacle 2. The female connector housing 8 is structured integrally from a main body portion 8A and a lever accommodating portion 8B arranged on one side (upper side in FIG. 1) of this main body portion 8A, as shown in FIG. 1.

The main body portion 8A is formed with a plurality of cavities 9 for accommodating the female terminal fittings 10. As shown in FIG. 1, the cavities 9 are arranged side by side in the height and width directions. As shown in FIG. 5, each cavity 9 penetrates in the connecting direction of the male and female connectors M, F and each female terminal fitting 10 is mounted on a leading end part of each wire and accommodated into the cavity 9 from behind. A deflectable locking lance 11 is formed in each cavity 9 and locks the female terminal fitting 10. Further, as shown in FIG. 1, a retainer 12 is mounted into the female connector housing 8. The retainer 12 locks each female terminal fitting 10 to doubly retain the female terminal fitting 10 together with the locking lance 11 described above. When the male and female connector housings 1, 8 are connected, front end openings of the respective cavities 9 allow the respective male terminal fittings 4 to be inserted into the corresponding cavities 9 to properly connect the male and female terminal fittings 4, 10.

Figure 1:
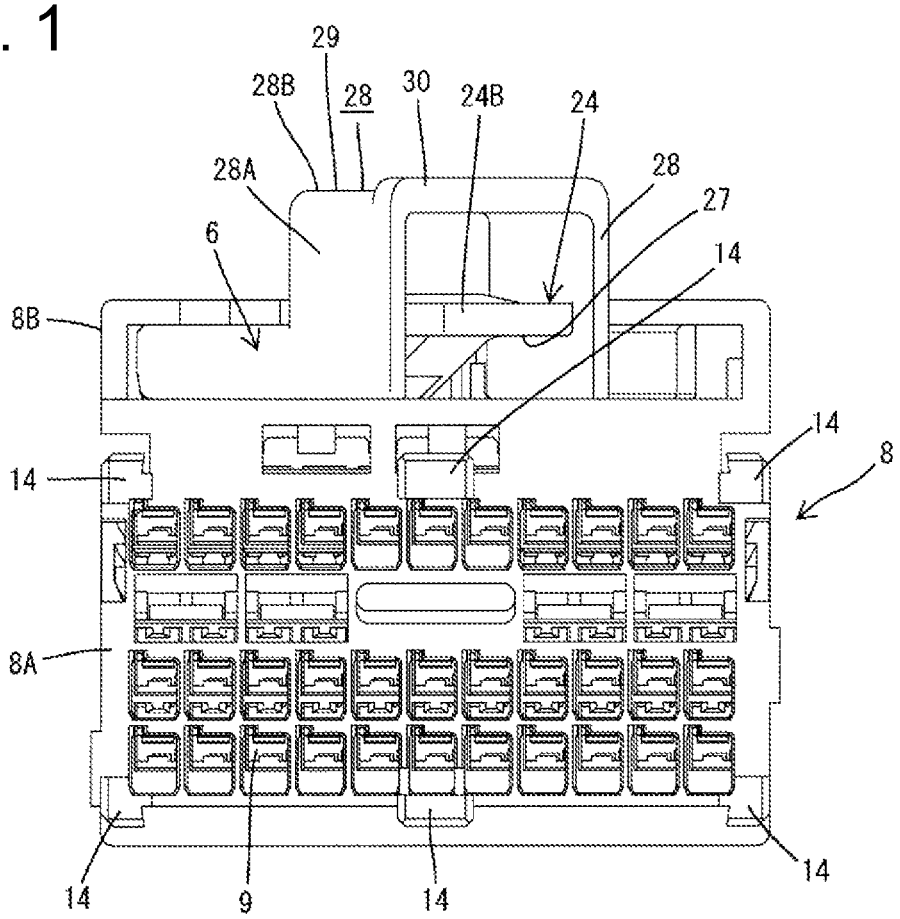
FIG. 1 is a rear view of a female connector.

As shown in FIGS. 1 and 5, mounting claws 14 for a wire cover 13 are provided on four corner parts and in widthwise centers of upper and lower edge parts, i.e. at a total of six positions, on a back surface side of the main body portion 8A. Each mounting claw 14 projects backward in the connecting direction from the rear surface of the main body portion 8A. The wire cover 13 is for correcting the respective wires pulled out from the rear surface of the female connector housing 8 in a set draw-out direction, and the respective wires are bundled, tapered and held at an exit part of the wire cover 13.

As shown in FIG. 2, the lever accommodating portion 8B is formed integrally over substantially the entire surface thereof on the shown upper surface side of the main body portion 8A, and the lever 6, to be described later, is mounted rotatably therein. The lever accommodating portion 8B is formed into a hollow frame open backward in the connecting direction. As shown in FIG. 2, an introducing opening 15 is open on the lever accommodating portion 8B for introducing the cam follower 5 on the side of the male connector M into the lever accommodating portion 8B. This introducing opening 15 is open from the front surface of the lever accommodating portion 8B in the connecting direction to the upper surface, and extends backward along the connecting direction on the upper surface. Further, an entrance groove 16 into which the releasing rib 7 on the side of the male connector M is to be introduced is open near an end part of the lever accommodating portion 8B. This entrance groove 16 is also open from the front surface of the lever accommodating portion 8B in the connecting direction to the upper surface, and extends farther backward than the introducing opening 15 substantially in parallel to the introducing opening 15 on the upper surface. Further, as shown in FIG. 2, the upper surface of the lever accommodating portion 8B is cut to form an escaping portion 17 for avoiding interference with the lever 6.

Next, the lever 6 is described. The lever 6 also is made integrally of synthetic resin. The lever 6 is substantially in the form of a plate that can be accommodated into the lever accommodating portion 8B and mounted rotatably about a rotary shaft 19 on a bottom surface (outer surface 18 of the main body portion 8A) in the lever accommodating portion 8B.

A locking arm 21 is formed on a peripheral edge part of the lever 6 via a slit 20 and is deflectable toward the slit 20. As shown in FIG. 3, the locking arm 21 extends toward a side wall in the lever accommodating portion 8B and a tip part thereof can be locked to a locking protrusion 22 formed to project on the side wall in the lever accommodating portion 8B. By locking the locking arm 21 to the locking protrusion 22, the lever 6 is held in a state where rotation in a clockwise direction shown in FIG. 3 is regulated. The position of the lever 6 shown in FIG. 3 is referred to as the initial position below. However, since an engagement margin of the locking arm 21 and the locking protrusion 22 in a thickness direction is small and a locking surface 22A of the locking protrusion 22 is a tapered surface, the locking of both is released by the deflection of the locking arm 21 toward the slit 20. Further, the rotation of the lever 6 at the initial position in a counterclockwise direction in FIG. 3 is regulated by the interference of the peripheral edge part of the lever 6 opposite to the locking arm 21 with the inner wall of the lever accommodating portion 8B.

As shown in FIG. 2, when the lever 6 is at the initial position, a part where the locking arm 21 and the locking protrusion 22 are locked to each other is exposed at a back part in the entrance groove 16. When the male and female connectors M, F are fit lightly, as shown in FIG. 3, the pressing surface 7A on the tip of the releasing rib 7 on the side of the male connector M can come into contact with the tip part of the locking arm 21 and resiliently deform the locking arm 21 to release the locking of the locking arm 21 and the locking protrusion 22.

Figure 6:
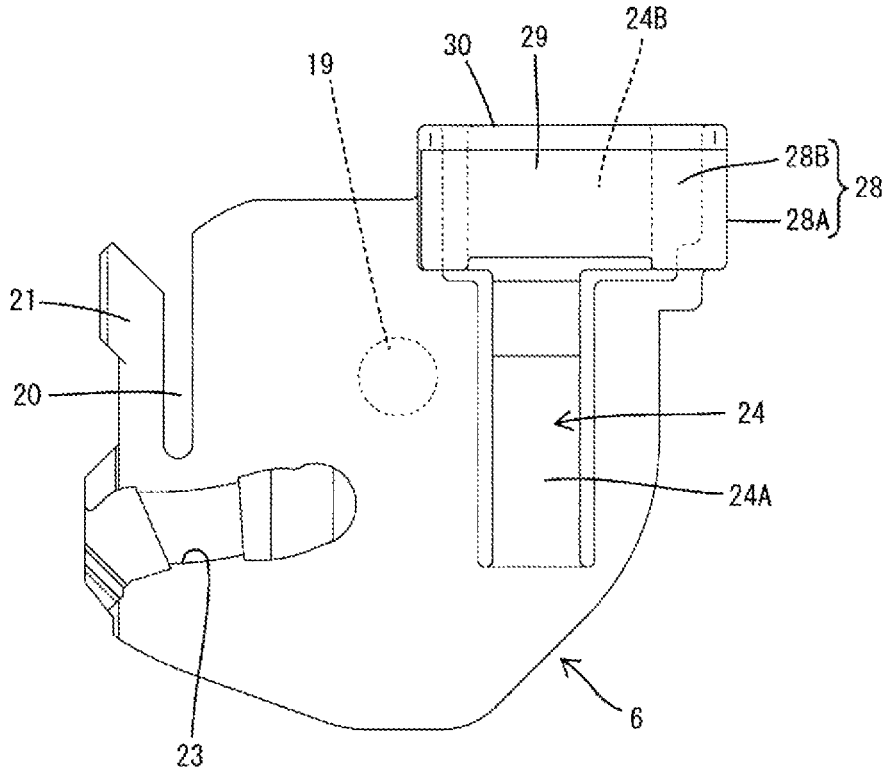
FIG. 6 is a plan view of the lever.

As shown in FIG. 6, the lever 6 is formed with a cam groove 23 and one end (entrance) of the cam groove 23 is open on the peripheral edge part of the lever 6. As shown in FIG. 2, when the lever 6 is at the initial position, one end side of the cam groove 23 is exposed at an intermediate position of the introducing opening 15 of the lever accommodating portion 8B. At this time, the opening (entrance) of the cam groove 23 is facing forward in the connecting direction. This enables the cam follower 5 to enter the entrance of the cam groove 23 when the male and female connectors M, F are fit lightly with the lever 6 held at the initial position.

Further, as shown in FIG. 6, the lever 6 is formed with a lock arm 24. This lock arm 24 functions to hold the lever 50 at a rotational position (hereinafter, this position is referred to as a connection end position; position shown in FIG. 4) by being locked to the lever accommodating portion 8B when the male and female connectors M, F are connected properly by rotating the lever 6 from the initial position. The lock arm 24 is arranged in a region opposite to the locking arm 21 and the cam groove 23 across the rotary shaft 19 of the lever 6.

As shown in FIG. 6, the lock arm 24 includes an arm portion 24A cantilevered from a position near one side of the lever 6 as a supporting point toward the peripheral edge part on the other side, and is deflectable in a direction away from the outer surface 18 of the main body portion 8A. The lock arm 24 is in such a posture that a longitudinal direction thereof is oblique to the connecting direction as shown in FIG. 3 when the lever 6 is at the initial position, but in such a posture that the longitudinal direction is parallel to the connecting direction as shown in FIG. 4 when the lever 6 is at the connection end position.

Figure 7:
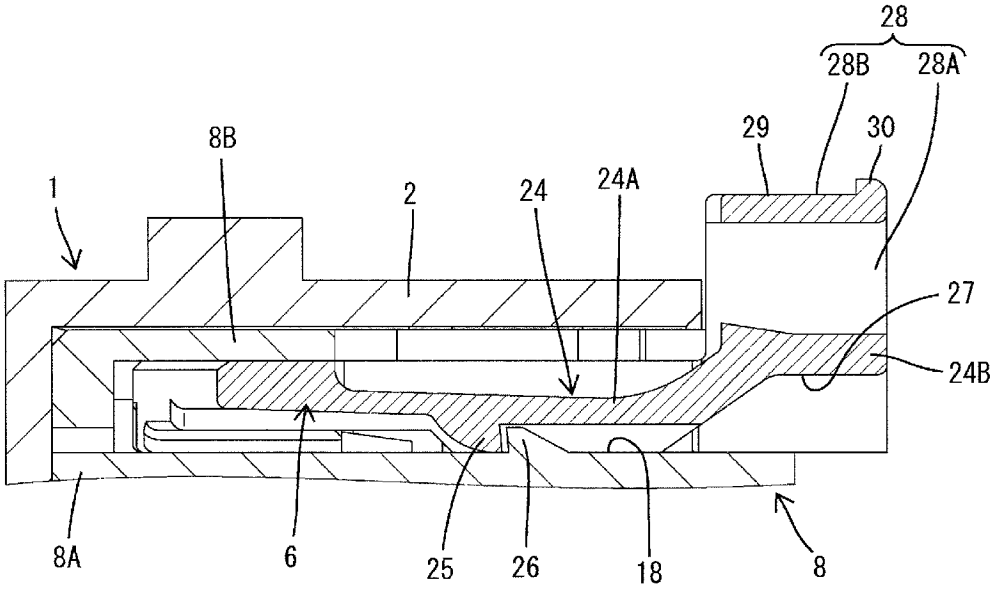
FIG. 7 is a section showing a locking state of a lock arm.

As shown in FIG. 7, a lock protrusion 25 projects in a longitudinal central part on the underside (side facing the outer surface 18 of the main body portion 8A) of the arm portion 24A. On the other hand, a locking projecting edge 26 projects on the bottom surface (outer surface 18 of the main body portion 8A) in the lever accommodating portion 8B. This locking projecting edge 26 is formed to have a predetermined width in a direction substantially orthogonal to the connecting direction although not shown in detail and regulates the rotation of the lever 6 in a direction to return to the initial position and the separation of the male and female connectors M, F by being locked to the lock protrusion 25 of the lever 6 when the lever 6 is at the connection end position. However, a height space is defined between the ceiling surface of the lever accommodating portion 8B and the arm portion 24A to allow deflection necessary to release the locking of the locking projecting edge 26 and the lock protrusion 25.

As shown in FIG. 3 and other figures, an operating portion 24B wider than the arm portion 24A is formed on a free end side of the arm portion 24A. As shown in FIG. 7, the operating portion 24B is formed to stand obliquely in a direction away from the outer surface 18 of the main body portion 8A. The underside of the operating portion 24B (surface facing the outer surface 18 of the main body portion 8A) serves as a first pinching surface 27 for lock release. As shown in FIG. 7, the first pinching surface 27 partly projects backward from the lever accommodating portion 8B (female connector F) when the lever 6 is at the connection end position. A projection length necessary for finger placement is ensured.

As shown in FIGS. 1, 7 and other figures, the lever 6 is formed with an arched protecting portion 28 for covering the entire operating portion 24B from a side facing the operating portion 24B in a deflecting direction of the operating portion 24B. The protecting portion 28 is composed of a pair of side walls 28A at opposite widthwise sides of the operating portion 24B and a coupling wall 28B coupling the upper ends of the side walls 28A. As shown in FIG. 7, the protecting portion 28 also projects out from the rear end of the female connector F similarly to the operating portion 24B when the lever 6 is at the connection end position. In this embodiment, the rear ends of the side walls 28A and the coupling wall 28B are substantially flush with the rear end edge of the operating portion 24B.

The coupling wall 28B is located above (right above) the operating portion 24B in a deflecting direction of the lock arm 24, and a second pinching surface 29 is formed on the upper surface. In the case of unlocking the lock arm 24, the arm portion 24A is deflected by pinching the first and second pinching surfaces 27, 29 from vertical sides. Thus, a distance between the coupling wall 28B and the operating portion 24B is set to allow the deflection of the arm portion 24 necessary for lock release. Note that a finger placing edge 30 projects up on the rear end of the second pinching surface 29 for anti-slip purpose during a pinching operation.

Next, functions and effects of this embodiment configured as described above are described. In the case of connecting the male and female connectors M, F with the lever 6 located at the initial position as shown in FIG. 2, the male and female connectors M, F first are fit lightly. At this time, the female connector housing 8 is fit into the receptacle 2 of the male connector M and the cam follower 5 of the male connector M enters the entrance of the cam groove 23 through the introducing opening 15 of the female connector F. Further, the tip of the releasing rib 7 comes into contact with the tip of the locking arm 21 during this time to deflect the locking arm 21 toward the slit 20. Since the locking of the locking arm 21 and the locking protrusion 22 is released in this way, the lever 6 is allowed to rotate clockwise from the initial position shown in FIG. 3.

The cam follower 5 is displaced along the cam groove 23 toward the back of the cam groove 23 as the lever 6 is rotated. Thus, the male and female connectors M, F can be connected with a small connecting force while being subjected to a force multiplying action by the lever 6. When the lever 6 reaches the connection end position shown in FIG. 4, the arm portion 24A of the lock arm 24 is deflected and deformed up so that the lock protrusion 25 moves over the locking projecting edge 26 and resiliently returns. In this way, the lever 6 is locked at the connection end position and, in addition, the male and female connectors M, F are held in a properly connected state, with the result that the male and female terminal fittings 4, 10 also are connected properly, as shown in FIG. 5.

Figure 8:
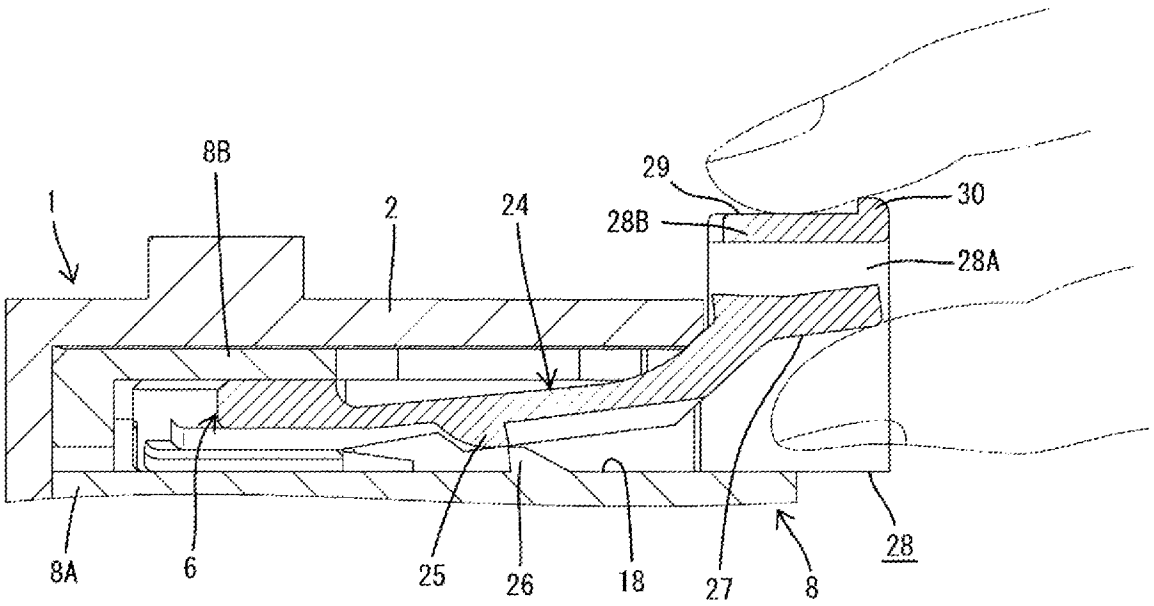
FIG. 8 is a section showing a state where the locking of the lock arm is released.

In the case of separating the male and female connectors M, F, for example, a thumb is placed on the first pinching surface 27 and an index finger is placed on the second pinching surface 29 to perform the pinching operation as shown in FIG. 8. This causes the lock arm 24 to be deflected and deformed in the direction away from the outer surface 18 of the main body portion 8A, and therefore the locking of the lock protrusion 25 and the locking projecting edge 26 is released. If the lever 6 is rotated counterclockwise from the connection end position shown in FIG. 4 with this pinched state kept, the cam follower 5 is displaced along the cam groove 23 toward the entrance side. In this process, the male and female connectors M, F are separated gradually. When the lever 6 is rotated to a position where the locking arm 21 is locked to the locking protrusion 22 (initial position), the peripheral edge part of the lever 6 interferes with the wall surface in the lever accommodating portion 8B to regulate any further rotation. Since the cam follower 5 has reached the entrance part of the cam groove 23 at this time, the two connectors M, F can be separated if a pulling force is applied to the male and female connectors M, F in a separating direction.

Effects of this embodiment are as follows.

When the first pinching surface 27 on the lock arm 24 and the second pinching surface 29 on the protecting portion 28 are pinched to separate the male and female connectors M, F in the connected state, the pinching surfaces are arranged in a direction along the deflecting direction of the lock arm 24. Thus, the pinching operation is facilitated as compared to a configuration in which both surfaces are arranged in a direction orthogonal to the deflecting direction. Therefore, the connectors can be smoothly separated.

The operating portion 24B of the lock arm 24 is covered by the protecting portion 28 to be protected from inadvertent lock release and damage caused by interference with external matters. Such a protecting portion 28 is a conventionally used existing one. Since the second pinching surface 29 is formed utilizing such a protecting portion 28 as an existing structure, it contributes to the simplification of the connector structure.

The first pinching surface 27 of the lock arm 24 projects outwardly from the rear end edge of the female connector F when the lever 6 is at the connection end position. Thus, the interference of an operator's finger with the female connector F during the pinching operation is avoided. Conversely, since a sufficient margin for finger placement can be ensured, the male and female connectors M, F can be separated smoothly.

The second pinching surface 29 projects back and up with the male and female connectors connected in this embodiment. Thus, the interference of the operator's finger with the female connector F during the pinching operation can be avoided. Thus, the male and female connectors M, F can be separated smoothly.

The present invention is not limited to the above described and illustrated embodiment. For example, the following embodiments are also included in the technical scope of the present invention.

Although the male terminal fittings 4 of the male connector housing 1 are connected to the printed circuit board 3 in the above embodiment, they may be connected to wires instead.

Although the lever 6 is arranged on one side of the female connector housing 8 in the above embodiment, a U-shaped lever 6 may be used and arranged on both sides.

Although the wire cover 13 is mounted on the female connector F in the above embodiment, it may be omitted.

The lever 6 may be mounted on the ceiling surface side (coupling wall side) besides being mounted on the bottom surface side in the lever accommodating portion 8B.

LIST OF REFERENCE SIGNS

1 . . . male connector housing (second connector housing)
5 . . . cam follower
6 . . . lever
8 . . . female connector housing (first connector housing)
8A . . . main body portion
18 . . . outer surface
23 . . . cam groove
24 . . . lock arm
24B . . . operating portion
27 . . . first pinching surface
28 . . . protecting portion
29 . . . second pinching surface
M . . . male connector
F . . . female connector

The invention claimed is:

1. A lever-type, comprising:

a first connector housing having a main body with an outer surface and a locking structure on the outer surface;

a second connector housing connectable to and separable from the first connector housing, and a cam follower provided on the second connector housing; and a lever rotatably provided on the outer surface of the main body of the first connector housing, the lever having a cam groove along which the cam follower moves to connect the first and second connector housings as the lever is rotated between an initial position and a connection end position;

a lock arm having a base end joined to the lever and a free end that is deflectable in a direction away from the outer surface of the main body of the first connector housing, the lock arm having a first surface facing the outer surface of the main body and a second surface opposite the first surface, a portion of the first surface of the lock arm between the ends being configured to engage the locking structure on the main body to hold the lever at the connection end position;

a first pinching surface formed on the first surface of the lock arm at the free end of the lock arm;

a protecting portion formed on the lever and configured to cover the second surface of the lock arm at the free end of the lock arm; and a second pinching surface formed on a part of an outer surface side of the protecting portion facing away from the lock arm and enabling the lever to rotate to the initial position by displacing the lock arm in an unlocking direction by pinching the first pinching surface toward the second pinching surface and away from the outer surface of the main body when the lever is at the connection end position.

2. The lever-type connector of claim 1, wherein the first pinching surface of the lock arm projects outwardly from an end edge of the first connector housing when the lever is at the connection end position.

3. The lever-type connector of claim 2, wherein the second connector housing includes a tubular receptacle externally fittable to the first connector housing and the second pinching surface is located to project outwardly from a leading end edge of the receptacle when the first and second connector housings are in a connected state.

4. The lever-type connector of claim 1, wherein the second connector housing includes a tubular receptacle externally fittable to the first connector housing and the second pinching surface is located to project outwardly from a leading end edge of the receptacle when the first and second connector housings are in a connected state.

5. The lever-type connector of claim 1, wherein the first and second pinching surfaces are substantially parallel to one another.

6. The lever-type connector of claim 1, wherein the unlocking direction of the lock arm is substantially parallel to a rotational axis of the lever during rotation of the lever between the initial position and the connection end position.

7. The lever-type connector of claim 1, wherein the locking structure on the outer surface of the main body of the first connector housing is a lock protrusion.

8. The lever-type connector of claim 7, wherein the first surface of the lock arm has a locking projecting edge that is engageable with the lock protrusion on the outer surface of the main body of the first connector housing when the lever is in the connection end position.

* * * * *